US010092818B2

(12) United States Patent
De Minicis et al.

(10) Patent No.: US 10,092,818 B2
(45) Date of Patent: Oct. 9, 2018

(54) SKATEBOARD

(71) Applicant: LINKY INNOVATION SRL, Falerone (FM) (IT)

(72) Inventors: Fabio De Minicis, Falerone (IT); Cristiano Nardi, Montegiorgio (IT); Paolo Pipponzi, Falerone (IT)

(73) Assignee: LINKY INNOVATION SRL, Falerone (FM) (IT)

( * ) Notice: Subject to any disclaimer, the term of this patent is extended or adjusted under 35 U.S.C. 154(b) by 0 days.

(21) Appl. No.: 15/580,484

(22) PCT Filed: Jun. 16, 2016

(86) PCT No.: PCT/EP2016/063931
§ 371 (c)(1),
(2) Date: Dec. 7, 2017

(87) PCT Pub. No.: WO2016/207062
PCT Pub. Date: Dec. 29, 2016

(65) Prior Publication Data

US 2018/0185740 A1 Jul. 5, 2018

(30) Foreign Application Priority Data

Jun. 23, 2015 (IT) ..... 102015000026490

(51) Int. Cl.
*A63C 17/01* (2006.01)
*A63C 17/02* (2006.01)
*A63C 17/12* (2006.01)

(52) U.S. Cl.
CPC ..... *A63C 17/12* (2013.01); *A63C 17/015* (2013.01); *A63C 2203/10* (2013.01); *A63C 2203/12* (2013.01); *A63C 2203/22* (2013.01); *A63C 2203/40* (2013.01)

(58) Field of Classification Search
CPC ..... A63C 17/12; A63C 17/01; A63C 17/015; A63C 17/012; A63C 17/0093; A63C 17/02
See application file for complete search history.

(56) References Cited

U.S. PATENT DOCUMENTS 4,580,799 A * 4/1986 Quinonez ..... A47C 9/022 280/32.6
6,131,931 A * 10/2000 Globerson ..... A63C 17/01 280/20

(Continued)

FOREIGN PATENT DOCUMENTS

WO WO-2014197927 A1 * 12/2014 ..... A63C 17/012

*Primary Examiner* — Bryan A Evans
(74) *Attorney, Agent, or Firm* — Egbert Law Offices, PLLC

(57) ABSTRACT

Skateboard having a board with a first platform and a second platform, fastenings fixed to the board, wheels rotatably mounted in the fastenings in order to move the board, a first frame-fixed to the first platform and a second frame fixed to the second platform, and connection means rotatably connecting the first frame to the second frame in such manner that the skateboard can be in an open position, in which the first platform and the second platform are aligned and coplanar, and in a closed position, in which the first platform and the second platform are parallel and disposed on different planes.

9 Claims, 7 Drawing Sheets

(56) References Cited

U.S. PATENT DOCUMENTS

| | | | | |
|---|---|---|---|---|
| 8,459,670 | B1 * | 6/2013 | Tizzone | A63C 17/015<br>280/87.042 |
| 2010/0219597 | A1 * | 9/2010 | Choi | A63C 17/0033<br>280/87.042 |
| 2016/0114242 | A1 * | 4/2016 | Riley | A63C 17/012<br>180/233 |

* cited by examiner

SKATEBOARD

The present patent application for industrial invention relates to an improved skateboard.

The skateboard is a scooter without handlebar composed of:

a board intended to support a user while standing;

fastenings fixed to the board;

wheels rotatably mounted in the fastenings in order to move the board.

The wheels can be directed with the pressure of the foot of the user.

As it is known, the board is approximately 75-80 cm long and consequently the volume of the skateboard is such to make transportation inside a backpack or a bag difficult. Moreover, these dimensions do not permit to transport the skateboard as carry-on luggage on airplanes, thus forcing the user to ship it as checked luggage.

In order to move with the skateboard the user must stand on the board and move the skateboard pushing with one foot on the ground. Because of this, the user needs to make a big physical effort, especially when riding uphill.

WO2014/197927 discloses a skateboard comprising a pair of deck members hinged together in such a way to pass from an open condition, in which the decks are aligned, to a closed condition, in which the decks define an enclosed volume.

U.S. Pat. No. 7,976,034 discloses a foldable skateboard comprising three decks, of which a front deck, a rear deck and a center deck hinged to the front deck and the rear deck.

The purpose of the present invention is to overcome the drawbacks of the prior art by disclosing a skateboard with reduced dimensions that does require no physical effort by the user.

Another purpose is to disclose a skateboard that is reliable and simple to use.

The skateboard of the invention comprises:

a board intended to support a user while standing;

fastenings fixed to the board;

wheels rotatably mounted in the fastenings in order to move the board, which comprises a first platform and a second platform.

Moreover, the skateboard comprises:

a first frame fixed to the first platform and a second frame fixed to the second platform, and connection means rotatably connecting the first frame to the second frame in such manner that the skateboard can be in an open position, in which the first platform and the second platform are aligned and coplanar, and in a closed position, in which the first platform and the second platform are parallel and disposed on different planes.

The peculiarity of the skateboard of the invention consists in the fact that said skateboard comprises a cursor fixed to the second platform and the second frame of the skateboard comprises a track to let said cursor slide along a longitudinal axis of the second frame, in such manner that the second platform can slide from a proximal position with respect to said first platform to a distal position with respect to said first platform.

The advantages of the skateboard of the invention are evident. Because of the connection means that allow for rotating the second platform relative to the first platform, the skateboard can easily go from the closed position with minimum volume to the open position intended for use and vice versa. In this way, the skateboard can be easily transported because it has a reduced volume in closed position.

For clarity purposes the description of the skateboard continues with reference to the attached drawings, which only have an illustrative, not limiting value, wherein.

Figure 1:
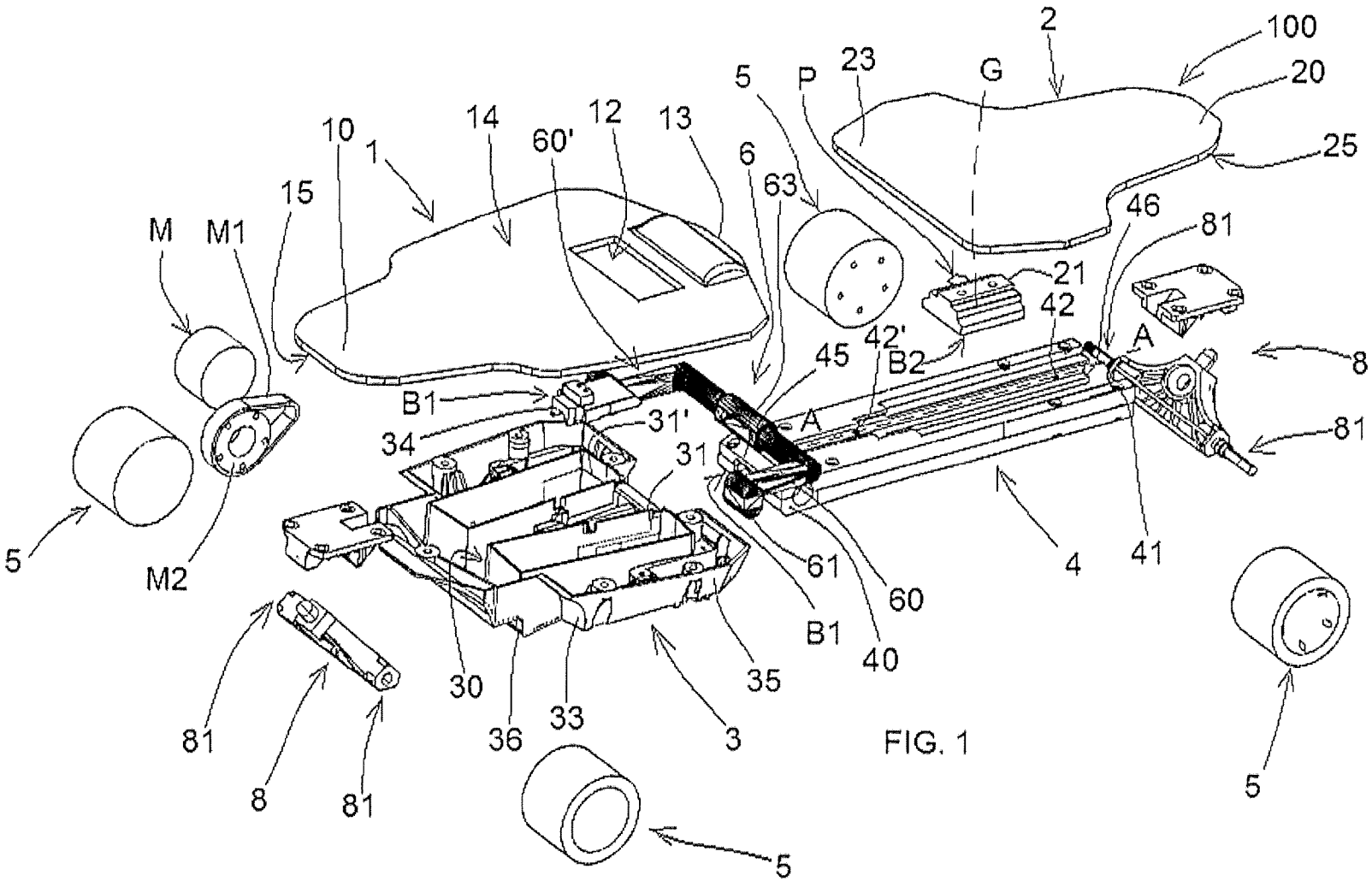
FIG. 1 is an axonometric exploded view of the skateboard of the invention.

With reference to FIGS. 1 to 5, a skateboard according to the invention is disclosed, which is generally indicated with reference numeral (100).

The skateboard (100) comprises a board comprising a first platform (1) and a second platform (2), substantially having the same longitudinal dimensions, that is to say a length lower than half of a traditional board for skateboards. Each platform (1, 2) is shaped as a substantially trapezoidal plate, wherein the edges of the platforms that form the major bases of the trapezium are intended to be mutually faced. In this way the board formed of the two platforms (1, 2) has a central part with higher width than the front and the rear portion.

With reference to FIG. 1, each platform (1, 2) comprises:

an upper surface (14, 24) intended to come in contact with the foot of the user, a lower surface (15, 25) intended to be faced towards the ground, an internal edge (13, 23) intended to be faced towards the other platform, and an external edge (10, 20) opposite to the internal edge (13, 23).

The skateboard (100) comprises two fastenings (8) fixed to the platforms (1, 2), in proximal position to the external edges (10, 20) of the first platform (1) and of the second platform (2). Each fastening (8) comprises two axes (81) that protrude externally in diametrically opposite position perpendicularly to the longitudinal axis of the skateboard.

The skateboard (100) comprises four wheels (5) rotatably mounted in the axes (81) of the fastenings in order to move the skateboard.

The skateboard (100) comprises a first frame (3) fixed to the lower surface (15) of the first platform (1).

The first frame (3) is a box structure comprising a perimeter wall (35) and a bottom wall (36) that define a compartment (30). The compartment (30) is closed on top by the first platform (1).

The first platform (1) comprises an opening (12) to access the compartment (30) when the compartment (30) is closed by the first platform (1). The perimeter wall (35) of the first frame (3) is shaped in such a way to have a substantially identical shape to the perimeter of the first platform (1).

The skateboard (100) comprises a second frame (4) fixed to the second platform (2). The second frame (4) is shaped as an elongated bar, comprising a first end (40) faced towards the first frame (3) and a second end (41) opposite to the first end (40). The second frame (4) has a longitudinal axis (A-A) that coincides with the longitudinal axis of the skateboard.

Figure 3:
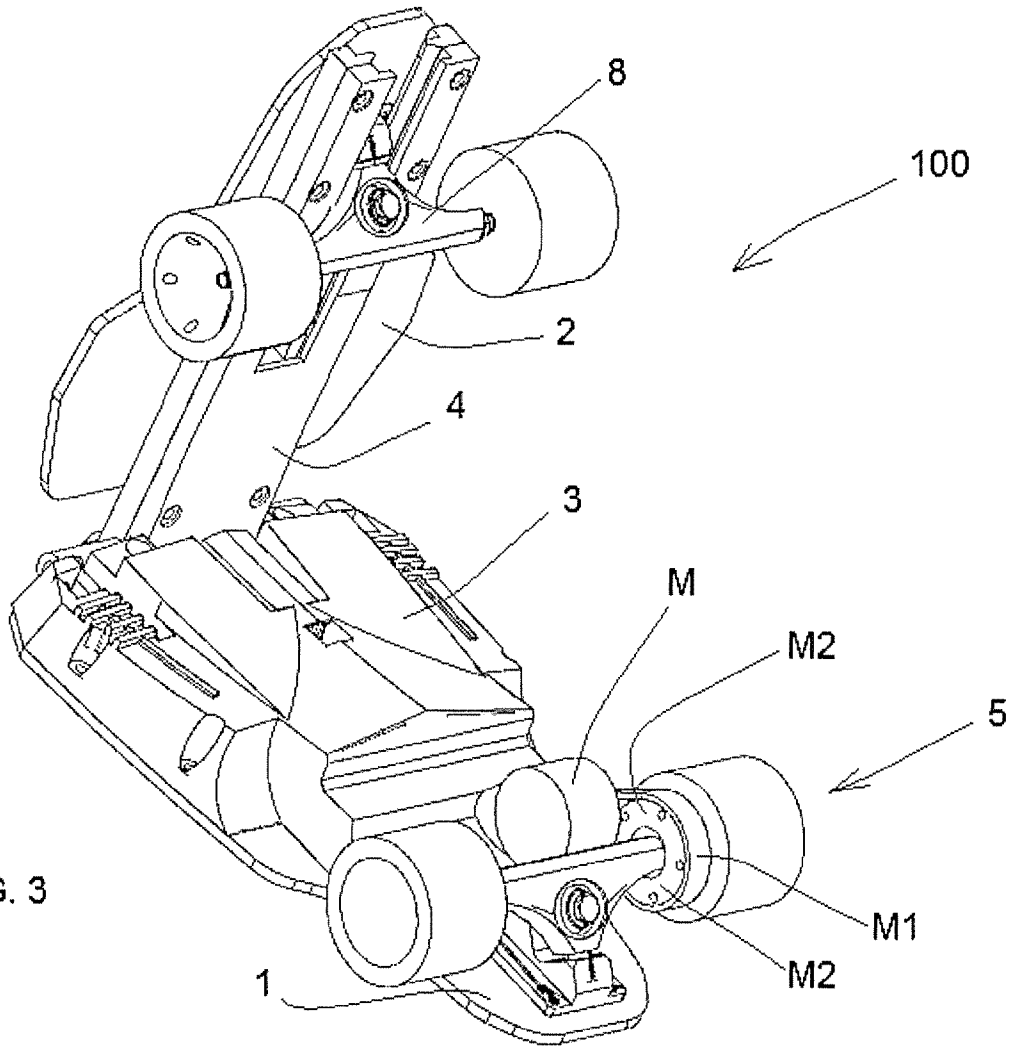
FIG. 3 is an axonometric view of the skateboard of FIG. 1 in an intermediate position.
Figure 4:
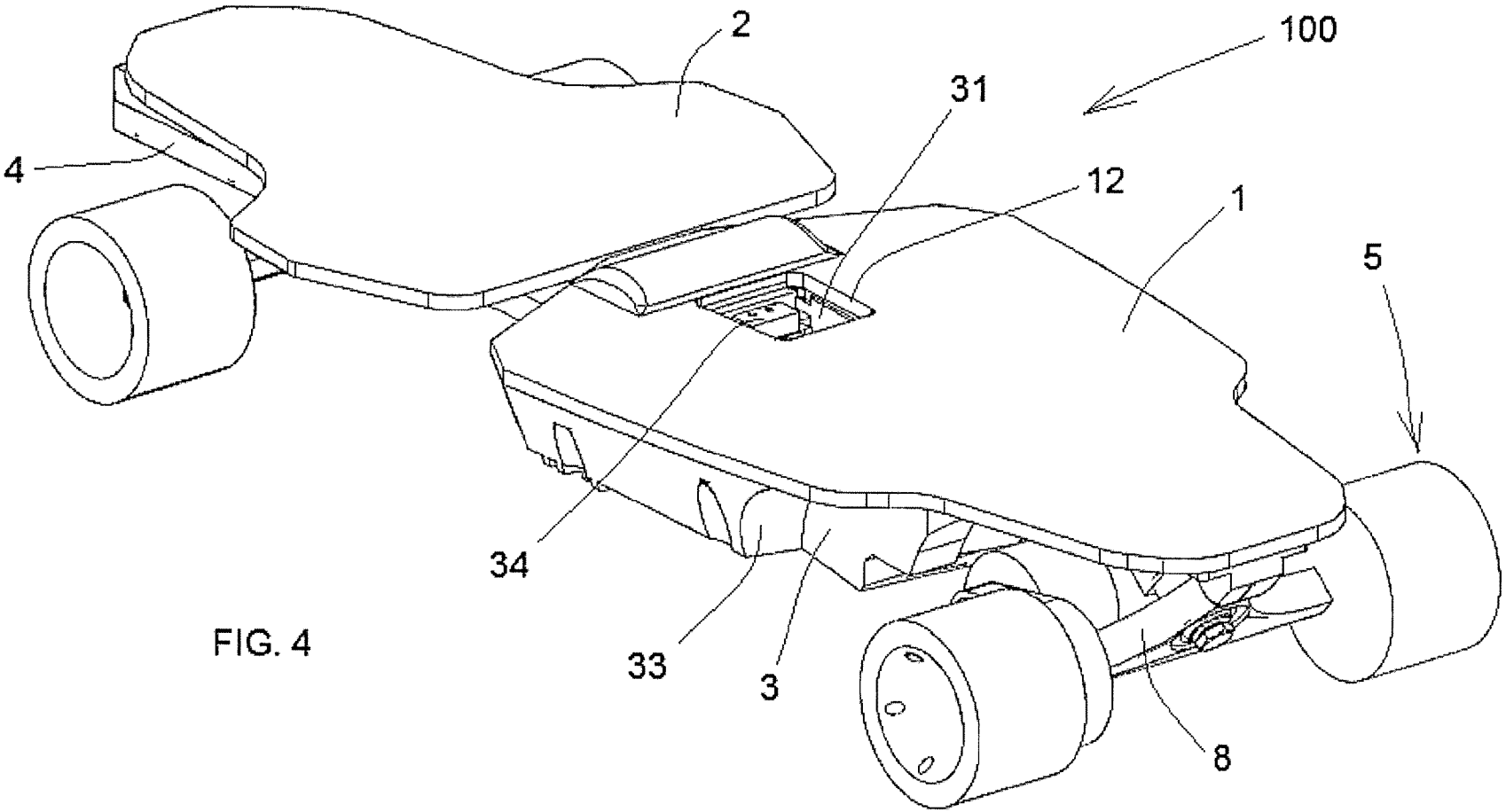
FIG. 4 is an axonometric view of the skateboard of FIG. 1 in an open contracted position.

As shown in FIG. 3, the skateboard (100) comprises an electric motor (M) mounted on the first frame (3). The electrical motor (M) is connected to a wheel (5) of the fastening of the first platform (1) by means of transmission means (M1, M2). The transmission means (M1, M2) comprise:

a pulley (M2) connected to the wheel (5), and a belt (M1) connecting the electric motor (M) to the pulley (M2).

By revolving, the electric motor (M) moves the belt (M1). The belt (M1) transmits the motion to the pulley (M2). The pulley (M2) makes the wheel (5) rotate. The electric motor (M) can revolve in both directions, consequently the wheel (5) can rotate in both directions. The skateboard (100) can be moved with front wheel drive or rear wheel drive according to the rotational direction of the electric motor (M) and according to the platform (1, 2) the user wants to use as front platform.

Although not shown in the figures, the compartment (30) of the first frame (3) houses a battery to power the electric motor (M).

The compartment (30) houses a Bluetooth module that communicates with a remote control in order to actuate and stop the rotation of the electric motor (M).

With reference to FIG. 1, the skateboard (100) comprises connection means (6) rotatably connecting the first frame (3) to the second frame (4), in such a way that the skateboard (100) can be in open position (FIG. 4), wherein the first platform (1) and the second platform (2) are aligned and coplanar, and in a closed position (FIG. 2), wherein the first platform (1) and the second platform (2) are parallel and disposed on different planes.

With reference to FIG. 1, the connection means (6) comprise a "U"-shaped element comprising a first rod (60) and a second rod (60') connected together by means of a bar (63). Advantageously, the rods (60, 60') and the bar (63) are made in one piece.

Figure 2:
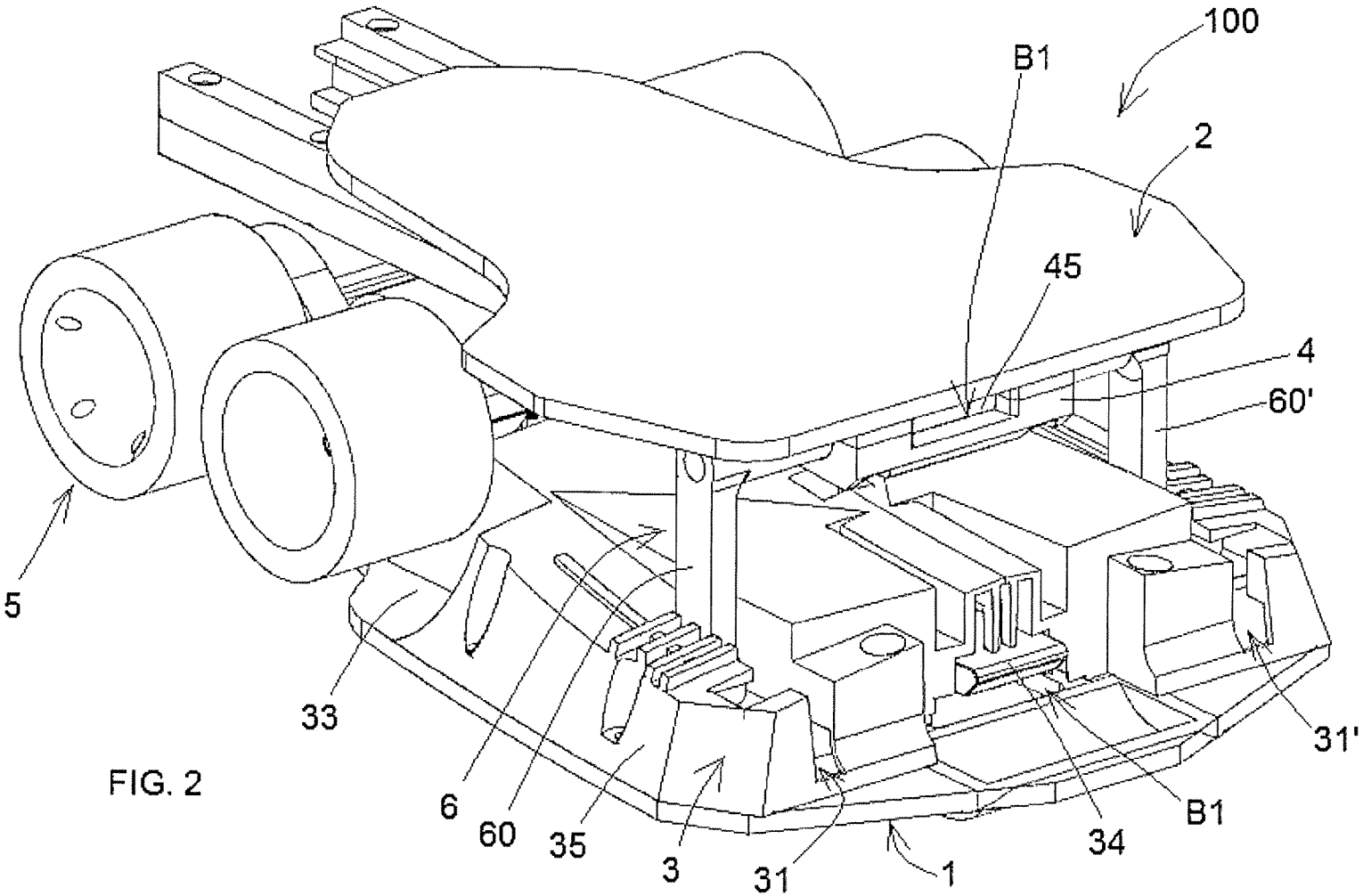
FIG. 2 is an axonometric view of the skateboard of FIG. 1 in a closed position.

Each rod (60, 60') comprises an end (61) hinged to the first frame (3). The bar (63) is hinged to the second frame (4) in such a way to rotate when the skateboard (100) passes from the closed position to the open position. When the skateboard (100) is in open position the rods (60, 60') are parallel to the longitudinal axis (A-A) of the second frame. When the skateboard (100) is in closed position the rods (60, 60') are orthogonal to the longitudinal axis (A-A) of the second frame. With reference to FIG. 2, two grooves (31, 31') are obtained in the perimeter wall (35) of the first frame in correspondence of the internal edge (13) of the first platform. The grooves (31, 31') are intended to house the rods (60, 60') when the skateboard (100) is in open position, in such a way to lock and firmly support the rods (60, 60') during the motion of the skateboard.

The first frame (3) comprises lateral seats (33) that are open on the bottom to house the wheels (5) connected under the second platform (2) when the skateboard (100) is in closed position.

The skateboard (100) also comprises locking means (B1) to lock the rotation of said first frame (3) with respect to the second frame (4) when the skateboard (100) reaches the open position.

The locking means (B1) comprise:

a striker (34) provided in the perimeter wall (35) of the first frame in correspondence of the internal edge (13) of the first platform, and a seat (45) provided in second frame (4) in correspondence of the internal edge (23) of the second platform.

The striker (34) passes through the seat (45) of the second frame, engaging in an opening (65) provided on the bar (63) of the connection means in order to lock the second frame (4) in aligned coplanar position with respect to the first frame (3) when the skateboard (100) reaches the open position. The striker (34) is fastened to the seat (65) of the connection means (6) by means of a spring that pushes the striker (34) inside the seat (65) of the connection means.

To release the striker (34) from the seat (45) of the second frame (4), the striker (34) is actuated through the opening (12) of the first platform (1). The striker (34) is released from the seat (45) of the second frame (4) to let the rods (60, 60') of the connection means (6) rotate.

Figure 5:
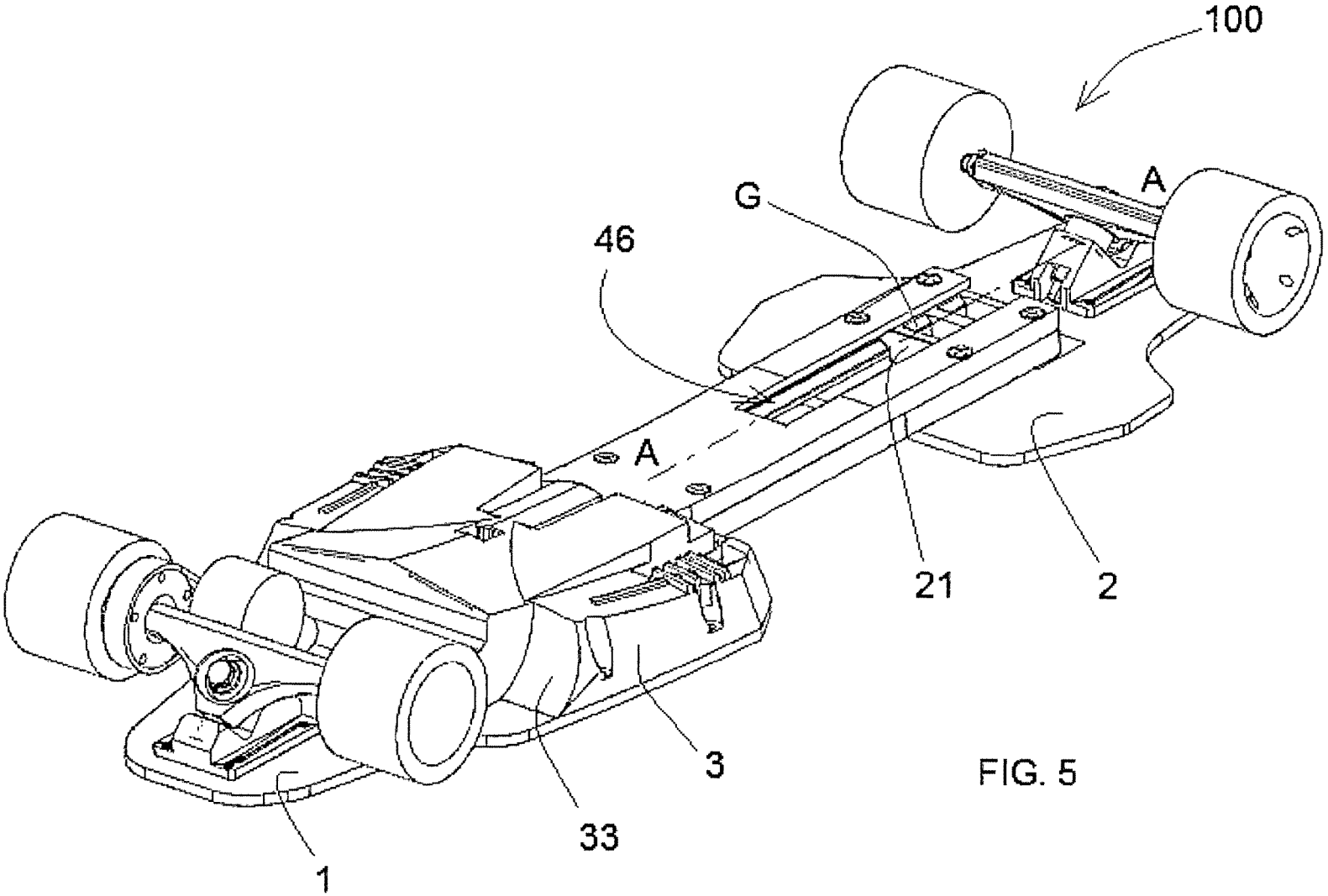
FIG. 5 is an axonometric view of the skateboard of FIG. 1 in an extracted position.

With reference to FIG. 5, the second frame (4) comprises a track (46) that extends from the second end (41) of the second frame (4) towards the first end (40) along the longitudinal axis (A-A) of the second frame (4) for a length equal to approximately half of the length of the second frame.

The skateboard (100) comprises a cursor (21) fixed to said second platform (2). The cursor (21) slides in the track (46) along the longitudinal axis (A-A) of the second frame (4) in such manner that the second platform (2) can slide from a proximal position with respect to the first platform (1) to a distal position with respect to the first platform (1).

Consequently, the skateboard (100) can be in a contracted position, wherein the first platform (1) and the second platform (2) are aligned, coplanar and in mutual contact, and in an extracted position, wherein the first platform (1) and the second platform (2) are aligned, coplanar and mutally spaced.

With reference to FIG. 1, the skateboard (100) comprises:

second locking means (B2) to lock the sliding of the second platform (2) when the second platform (4) is in a position proximal with respect to said first platform (1) or in distal position with respect to said first platform (3); and second releasing means (S2) to release the second locking means (B2).

The second locking means (B2) comprise:

a spring-loaded pin (P) connected to the cursor (21), a distal seat (42) provided on the track (46) in distal position with respect to the first platform, and a proximal seat (42') provided on the track (46) in proximal position with respect to the first platform.

The spring-loaded pin (P) is positioned inside the cursor and is stressed towards the outside of the cursor. Therefore, the pin (P) is automatically engaged in the distal seat (42) or in the proximal seat (42'), when the cursor (21) reaches one of said seats (42, 42').

The second releasing means (S2) comprise a handle (G) connected to the pin (P) to allow for the retraction of the pin (P) against the action of the spring and consequently for the ejection of the pin (P) from the distal seat (42) or from the proximal seat (42') of the track. By actuating the handle (G), the pin (P) is inserted inside the cursor (21), to let the cursor (21) slide on the track (46).

Although a pin (P) is illustrated in the figures, alternatively, instead of the pin (P) the locking means (B1) can comprise a spring-loaded ball connected to the cursor (21). The ball is stressed by the spring towards the cursor. Therefore, the ball is automatically engaged in the distal seat (42) or in the proximal seat (42') when the cursor (21) reaches one of said seats (42, 42'). In such a case, no release means are provided because the ball is released from the seats (42, 42') by pushing or pulling the second platform (2)

along the longitudinal axis (A-A) of the second frame (4) to let the ball come out from the seat (42, 42').

The following steps are required for the skateboard (100) to go from the closed position to the extracted position:

rotation of the rods (60, 60') by approximately 90° around the first end (61) of the rods, in such a way that the second platform (2) is orthogonal to the first platform (1);

rotation of the rods (60, 60') by approximately 90° around the bar (63) of the connection means, in such a way that the second platform (2) is coplanar to the first platform (1);

actuation of the handle (G) in such a way to release the pin (P) from the proximal seat (42');

sliding of the cursor (21) from the proximal seat (42') to the distal seat (42) in such a way that the first platform (3) and the second platform (4) are mutually spaced.

The following steps are required in order for the skateboard to go from the extracted position to the closed position:

actuation of the handle (G) in such a way to release the pin (P) from the distal seat (42');

sliding of the cursor (21) from the distal seat (42') to the proximal seat (42) in such a way that the first platform (3) and the second platform (4) are in mutual contact;

release of the striker (34) from the seat (45) of the second frame (4);

rotation of the rods (60, 60') by approximately 90° around the bar (63) of the connection means, in such a way that the second platform (2) is orthogonal to the first platform (1);

rotation of the rods (60, 60') by approximately 90° around the first end (61) of the rods, in such a way that the second platform (2) is parallel but not coplanar to the first platform (1);

The skateboard (100) can easily go from the closed position to the extracted position and vice versa, thanks to the connection means (6) and the cursor (21) that respectively allows for the rotation and the sliding of the second platform (2) relative to the first platform (1). In this way, the skateboard (100) can be easily transported because the skateboard (100) has a reduced volume when it is in closed position.

Moreover, because of the presence of the electric motor (M) that can rotate in both directions, the skateboard (100) allows for moving easily with no physical effort.

Figure 6:
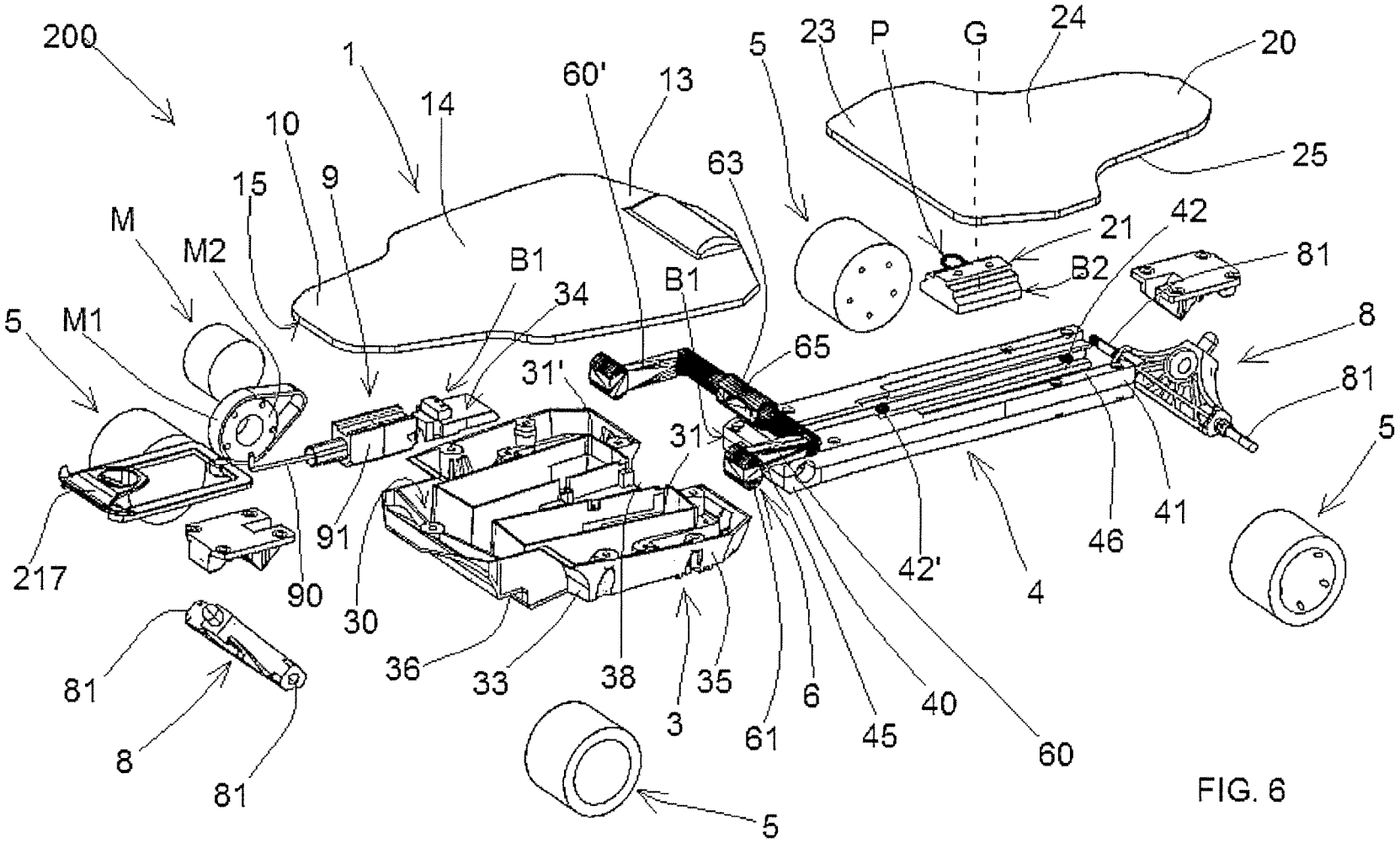
FIG. 6 is an axonometric exploded view of a second embodiment of the skateboard of the invention.
Figure 7:
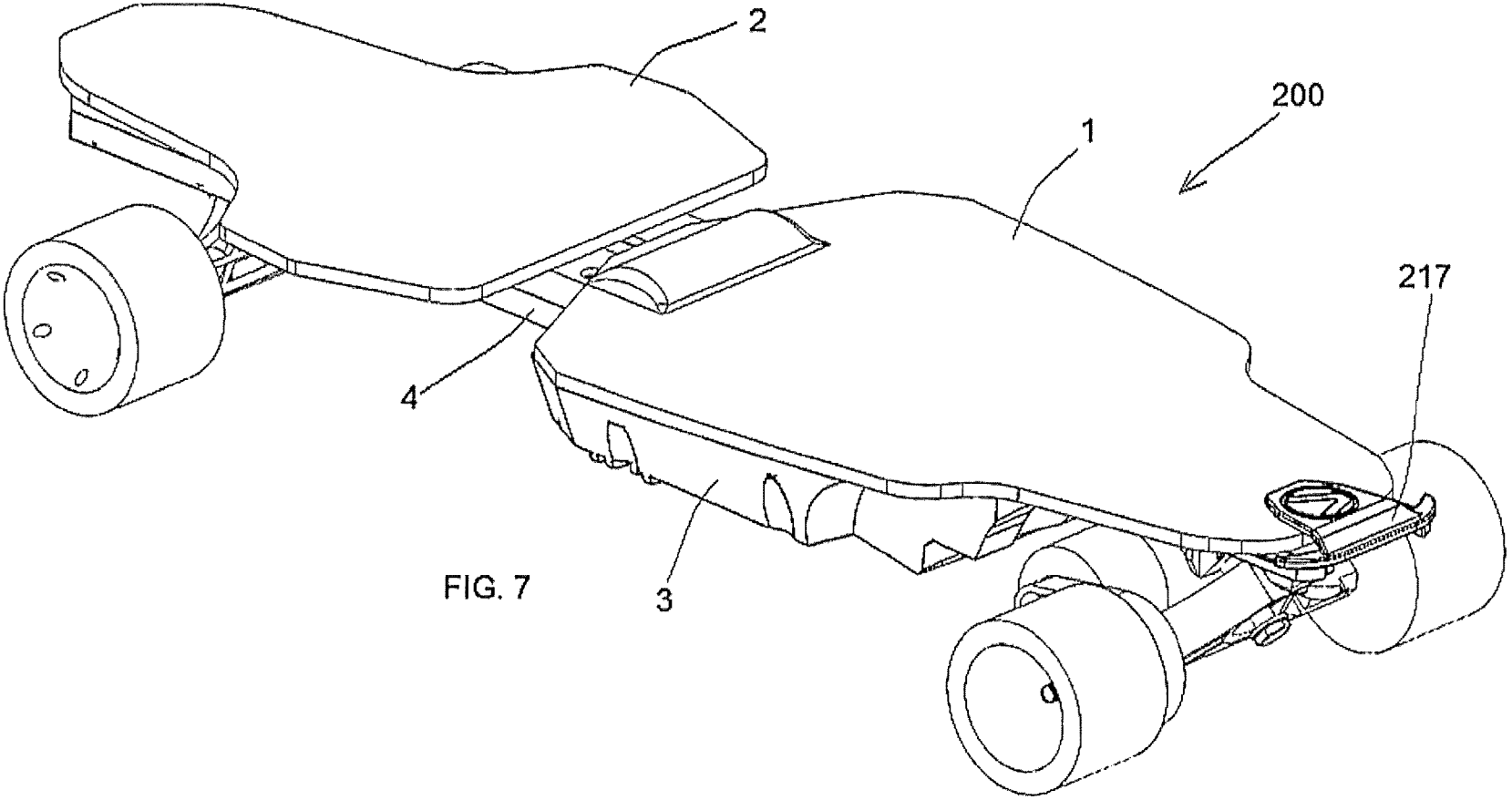
FIG. 7 is an axonometric view of the skateboard of FIG. 6 in an open contracted position.

With reference to FIGS. 6 and 7, a second embodiment of the skateboard according to the invention is disclosed, being generally indicated with reference numeral (200). In the following description the parts that are identical or correspond to the parts described above are identified with the same numerals, omitting their detailed description.

The skateboard (200) comprises a handle (217) disposed under the first platform (1) to release the striker (34) from the seat (45) of the second frame. The handle (217) protrudes from the external edge (10) of the first platform and is connected to the striker (34) by means of an actuator (9). The actuator (9) comprises a stem (90) connected to the handle (217) and to the striker (34). The stem (90) is loaded with a spring disposed between the striker (34) and the frame (3) and held in position inside a cylinder (91) fixed to the first frame. By actuating the handle (217) manually, the striker (34) is extracted and retracted with respect to the cylinder (91).

The stem (90) and the cylinder (91) are disposed inside the compartment (30) of the first frame (3). The perimeter wall (35) of the first frame comprises a niche (38) to let the striker (34) come out from the compartment (30) in order to engage in the seat (45) of the second frame.

The handle (217) actuates on the actuator (9) to release the striker (34) from the seat (45) of the second frame (4). By pushing the handle (217) with a strength higher than the elastic force of the spring, the striker passes through the seat (45) of the second frame (4) and is engaged in the opening (65) of the bar (63) of the connection means, locking the skateboard (200) in open position. By actuating the handle (217) again, the spring pushes the striker (34) towards the first frame (3) and lets the striker (34) come out from the seat (45) of the second frame (4). In this way the rods (60, 60') can rotate and the skateboard (200) can go from the open position to the closed position.

The invention claimed is:

1. Skateboard comprising:

a board intended to support a user while standing; said board comprising a first platform and a second platform;

fastenings fixed to the board;

wheels rotatably mounted in the fastenings in order to move the board;

a first frame fixed to the first platform and a second frame fixed to the second platform; and connection means rotatably connecting said first frame to said second frame in such manner that said skateboard can be in an open position, in which the first platform and the second platform are aligned and coplanar, and in a closed position, in which the first platform and the second platform are parallel and disposed on different planes;

wherein said skateboard comprises a cursor fixed to said second platform; and said second frame comprises a track for said cursor to slide along a longitudinal axis of the second frame in such manner that said second platform slides from a proximal position with respect to said first platform to a distal position with respect to said first platform.

2. The skateboard of claim 1, wherein said connection means comprise at least one rod hinged in said first frame and in said second frame in such manner to rotate when the skateboard passes from the closed position to the open position.

3. The skateboard of claim 1, also comprising:

locking means to lock the rotation of said first frame with respect to the second frame when the skateboard reaches the open position.

4. The skateboard of claim 3, wherein said locking means comprise a striker provided in said first frame that is engaged in a seat provided in said second frame to fasten said second frame to said first frame when the skateboard reaches the open position.

5. The skateboard claim 1, wherein said first frame comprises lateral seats that are open on the bottom to house the wheels connected under the second platform when the skateboard is in the closed position.

6. The skateboard of claim 1, comprising second locking means to lock the sliding of said second platform when the second platform is in a position proximal with respect to said first platform or in distal position with respect to said first platform.

7. The skateboard of claim 6, wherein said second locking means comprise a pin or a spring-loaded ball connected to said cursor that is engaged in a distal seat provided on said track in distal position with respect to the first platform and in a proximal seat provided on said track in proximal position with respect to the first platform.

8. The skateboard of claim 1, comprising an electric motor connected to a wheel.

9. The skateboard of claim 8, wherein said first frame is a box structure comprising a compartment adapted to house a battery for powering the electric motor, said compartment being closed by said first platform.

* * * * *